US011325736B2

(12) United States Patent
Gabusi et al.

(10) Patent No.: US 11,325,736 B2
(45) Date of Patent: May 10, 2022

(54) EXTRACTION ASSEMBLY OF A CONTENT FROM A BAG FOR PHARMACEUTICAL AND CHEMICAL SECTORS

(71) Applicant: I.M.A. INDUSTRIA MACCHINE AUTOMATICHE S.P.A., Ozzano Dell'Emilia (IT)

(72) Inventors: Gabriele Gabusi, Castenaso (IT); Claudio Trebbi, Medicina (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 602 days.

(21) Appl. No.: 16/321,444

(22) PCT Filed: Jul. 24, 2017

(86) PCT No.: PCT/EP2017/068674
§ 371 (c)(1),
(2) Date: Jan. 28, 2019

(87) PCT Pub. No.: WO2018/019785
PCT Pub. Date: Feb. 1, 2018

(65) Prior Publication Data

US 2021/0292033 A1 Sep. 23, 2021

(30) Foreign Application Priority Data

Jul. 27, 2016 (IT) ..... 102016000078602

(51) Int. Cl.
*B65B 69/00* (2006.01)

(52) U.S. Cl.
CPC ..... *B65B 69/0008* (2013.01)

(58) Field of Classification Search
CPC ..... B65B 69/00; B65B 69/008; B25J 21/00; B25J 21/005; B25J 1/08
See application file for complete search history.

(56) References Cited

U.S. PATENT DOCUMENTS 5,870,886 A * 2/1999 Norton ..... A61L 2/26 53/492
7,587,882 B2 * 9/2009 Rocholl ..... B65B 69/0008 414/412

(Continued)

FOREIGN PATENT DOCUMENTS

DE 102011080289 A1 2/2013
DE 102014201961 A1 8/2015
WO WO-2013/017315 A2 2/2013

OTHER PUBLICATIONS

International Search Report and Written Opinion for PCT/EP2017/068674, dated Oct. 10, 2017.

*Primary Examiner* — Mark C Hageman
(74) *Attorney, Agent, or Firm* — Marshall, Gerstein & Borun LLP

(57) ABSTRACT

An extraction assembly for extracting content from a bag, said bag having an end mouth formed by two opposing flaps, comprising a separation wall which separates a first environment and a second environment at different contamination classes and which is provided with an opening communicating the first environment and the second environment, closing partitions at the opening movable between a closing position and an opening position, and a gripper to keep closed said flaps and wherein each closing partition has coupling elements to couple with a gripper, wherein said gripper and said coupling elements include a retention device, the spacing apart of partitions causing opening of the jaws and the opening of the end mouth and the communicating of the inside of the bag and of the content with said second environment through said opening.

13 Claims, 6 Drawing Sheets

(56) References Cited

U.S. PATENT DOCUMENTS

| | | | | |
|---|---|---|---|---|
| 9,511,884 | B2 * | 12/2016 | Untch | B65B 69/0075 |
| 2013/0134068 | A1 | 5/2013 | Nicoletti | |
| 2014/0182742 | A1 | 7/2014 | Capelli | |

* cited by examiner

EXTRACTION ASSEMBLY OF A CONTENT FROM A BAG FOR PHARMACEUTICAL AND CHEMICAL SECTORS

BACKGROUND OF THE INVENTION

Field of the Invention

Object of this invention is an extraction assembly of a content within a bag for pharmaceutical and chemical sectors.

Related Technology

The bags of specific interest are intended for the containment and segregation of containers such as vials, medicine bottles, syringes, carpules and the like with respect to the outside environment.

These containers are subjected to washing and sterilisation treatments to ensure that there is no residue inside them (not even dust particles and the like) and to remove any contaminants from their surfaces.

These containers are also normally collected on a nest that is similarly subjected to similar washing and sterilisation treatments.

The nest is, in turn, arranged inside a sterile tub and surmounted by a protective sheet having the purpose of preventing entry into the containers (which have a upper mouth open outwards) of dust or other particles.

The upper edges of the tub (containing protective foil, nest and containers) are permanently coupled to a sealing film to completely isolate the inside of the tub from outside.

The tub thus closed is arranged within a bag (generally made of polymeric material) which constitutes a second protective barrier (since the outside of the tub and the sealing film must in any case also be sterile).

In this way, it is possible to transport the containers thus packaged with the guarantee that they will not be subjected to involuntary contamination.

Once reached the factory where the containers are to be filled with specific substances of various kinds, it will become necessary to manipulate them for transporting them, first to the station at which the bag will be opened, then at the station where the opening film will be removed, and finally at the filling station of each single container.

These operations will be performed in environments with a specific particle contamination Class (filling operations will be performed in the environment with the least risk of contamination).

The environments and products are identified by contamination Classes defined according to legislation ISO14644/1: the highest contamination Class (therefore the environment with the least number of particles) corresponds substantially at least to that defined as "ISO 5 Class" (it could also be an ISO 4, 3, 2, 1 Class).

It is appropriate that the bag opening operations are carried out in an environment with a lower contamination risk than that at which said bags are transported, while the tub may be deprived of the protective film only at the least risk contamination environment (for example, in an environment with ISO 5 contamination Class or lower), by imposing further constraints on the step wherein to remove the protective film thereof.

It is specified that even the atmosphere inside the bag will have a very low contamination Class (hence an ISO Class less than or equal to 5).

It is therefore evident that one of the most delicate operations of the entire transport and delivery process of the packets occurs at the transfer of the content of the bag (i.e., of the tub wherein is housed the nest supporting the containers to be filled) from the environment having a higher risk of contamination to the environment with lower risk (where there will be a lower number of particles and contaminants in the atmosphere).

The environments will be identified by different contamination Classes, wherein the Class with more restrictive parameters implies the minimum number of particles and contaminants in the relative atmosphere.

If the content of the bag is extracted into the environment with a lower contamination Class, the content is exposed (in the particular case so far described, the tub) to possible contaminations with particles and the like.

Extracting the content from the bag within the environment with the upper contamination Class means instead introducing a surface (the outside of the bag) onto which particles could potentially accumulate, whereby this environment would be contaminated.

It is known that the extraction of the content from a bag is performed close to an opening on a wall separating two environments, but also this assumption implies the possible contamination of the content exposed for a short time to the environment having a low the least contamination Class.

SUMMARY OF THE INVENTION

The main purpose of this invention is to solve the problems outlined above by providing an extraction assembly of a content from a bag for pharmaceutical and chemical sectors where the risk of contamination of the content of the bag is to be minimised.

Within the scope of this task, one object of the invention is to provide an extraction assembly of a content from a bag for pharmaceutical and chemical sectors wherein is minimised the risk of contamination of the content of the bag during the extraction from the bag.

Another object of the invention is to provide an extraction assembly of a content from a bag for pharmaceutical and chemical sectors wherein the content of the bag is never exposed to an environment classified with a contamination Class lower than that expected in an operating environment where the content of the bag will be processed.

A further object of this invention is to provide an extraction assembly of a content from a bag for pharmaceutical and chemical sectors with reduced costs and relatively simple practical manufacture and safe application.

This task and these objects are achieved by an extraction assembly of a content from a bag for pharmaceutical and chemical sectors according to claim 1.

BRIEF DESCRIPTION OF THE DRAWINGS

Further characteristics and advantages of the invention will become apparent from the description of a preferred, but not exclusive, embodiment of the extraction assembly of a content from a bag for pharmaceutical and chemical sectors according to the invention, illustrated by way of non-limiting example, in the accompanying drawings, wherein.

DETAILED DESCRIPTION

Figure 1A:
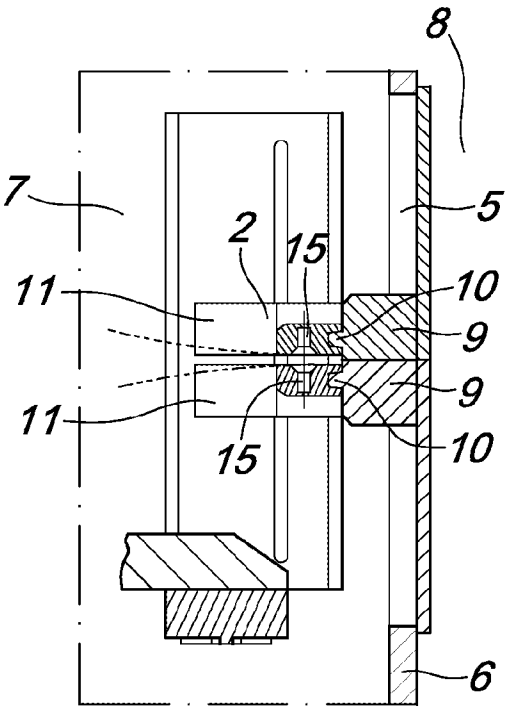
FIG. 1*a* is an enlarged detail of FIG. 1.
Figure 1:
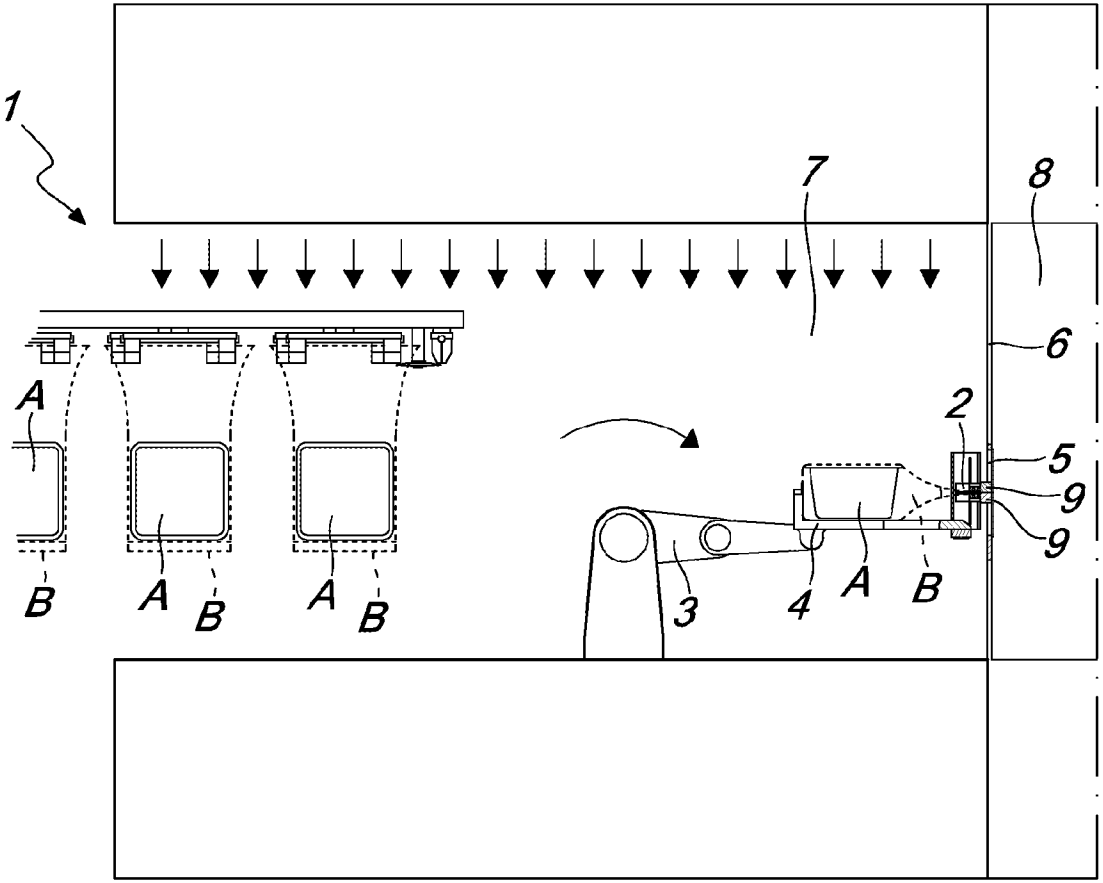
FIG. 1 is a schematic side view of an extraction assembly of a content from a bag for pharmaceutical and chemical sectors according to the invention in a first operating step.
Figure 2A:
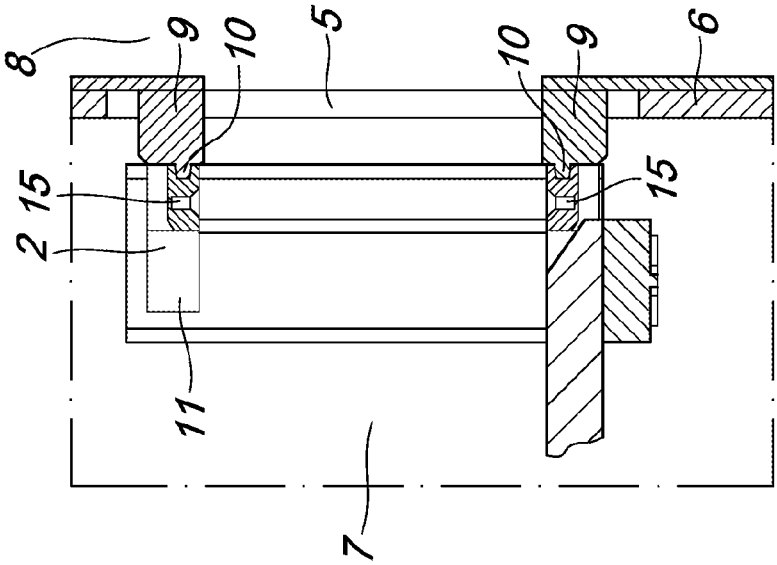
FIG. 2*a* is an enlarged detail of FIG. 2.
Figure 2:
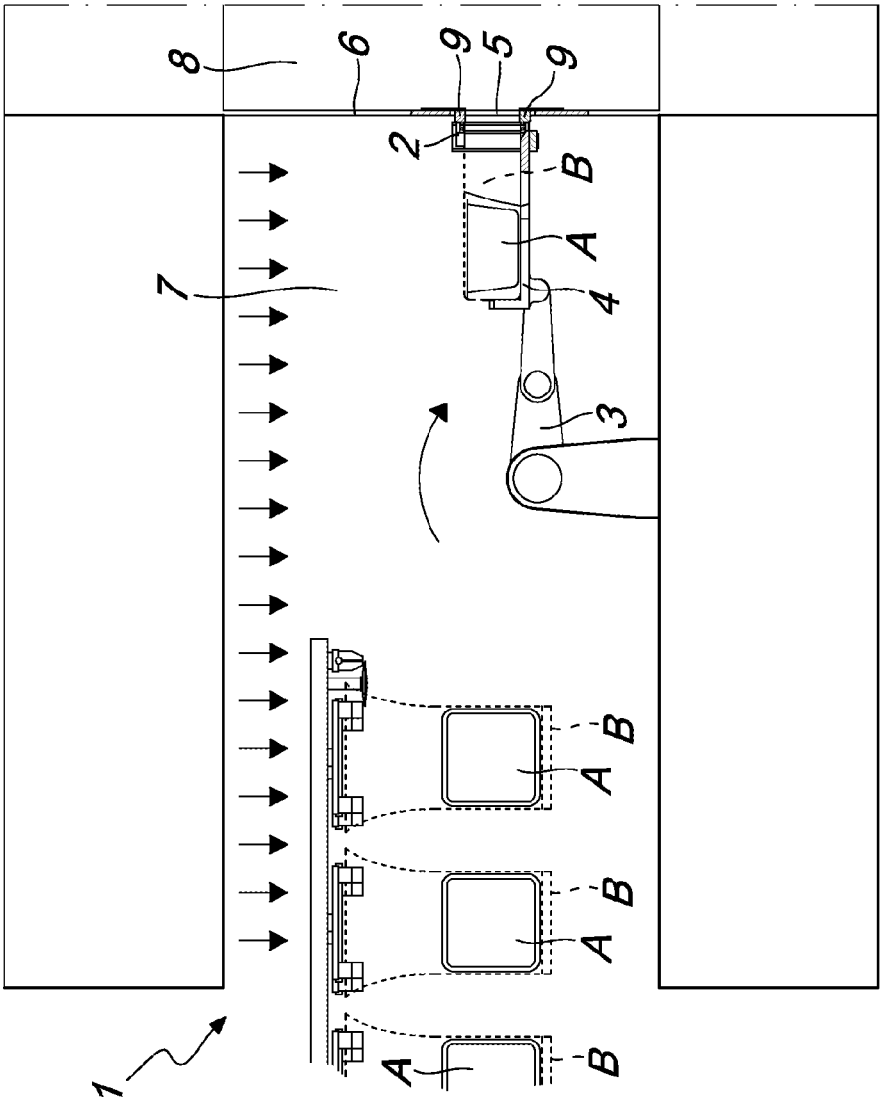
FIG. 2 is a schematic side view of the extraction assembly of FIG. 1 in a second operational phase.

With particular reference to these Figures, it is generally indicated with 1 an extraction assembly of a content A from a bag B for pharmaceutical and chemical sectors.

The bag B is generally hermetically closed and preferably made of polymeric material.

The content A that can be of various kinds is located within the bag. It is specified that according to a possible embodiment of undoubted interest, content A could consist of a tub wherein a nest will be housed which will accommodate a plurality of containers such as vials, syringes, medicine bottles, carpules and the like.

It is not excluded to process (through the assembly according to the invention) also other containers of other nature and with other characteristics.

In any case, it is envisaged that the bag B is provided with an end mouth formed by two opposite flaps: in the event wherein the bag is made of polymeric material sheets (assumption of predominant application interest), these opposed flaps will consist of sheet portions that will make the opposite faces of the bag B thereof.

Assembly 1 according to the invention comprises a separation wall 6 between a first environment 7 and a second environment 8 at different contamination Class.

The separation wall 6 has an opening 5 which communicates the first environment 7 and the second environment 8. The opening 5 has movable closing partitions 9 between a closing position wherein they shut the opening 5 and an opening position wherein they free the opening 5.

The assembly 1 according to the invention further comprises a gripper 2 housed in the first environment 7 and configured for keeping tightly sealed the end mouth flaps of the bag B.

In accordance with this invention, each closing partition 9 has preferably coupling elements 10 to a respective jaw 11 of the gripper 2, wherein at least one of the jaws 11 and the coupling elements 10 has at least one retention device 15 of the bag B. When the closing partitions 9 move to the opening position (spaced apart from one another), they cause the spacing apart of the jaws and the consequent opening of the end mouth of the bag B by means of the retention device 15 and the communication of the inside of the bag and the corresponding content A with the second environment 8 through the opening 5 on the separation wall 6.

The gripper 2 is preferably integral with a handling device 3 housed in the first environment 7.

The handling device 3 comprises supporting members 4 for the bag B and is movable along a trajectory for bringing the supporting member 4 to the opening 5.

Figure 4:
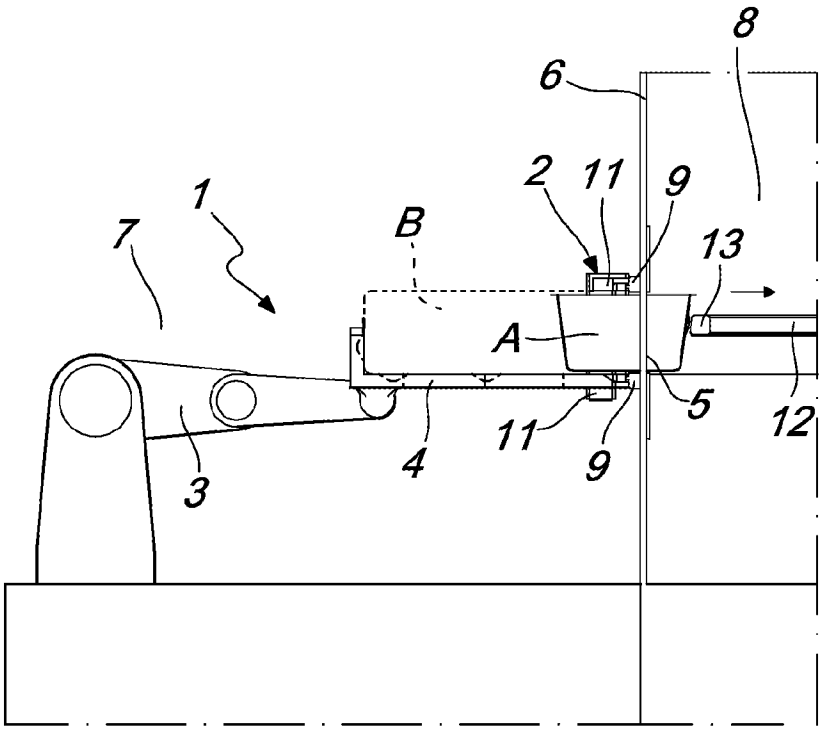
FIG. 4 is a schematic side view of the first embodiment of the extraction assembly of FIG. 1 in a fourth operating step.
Figure 3:
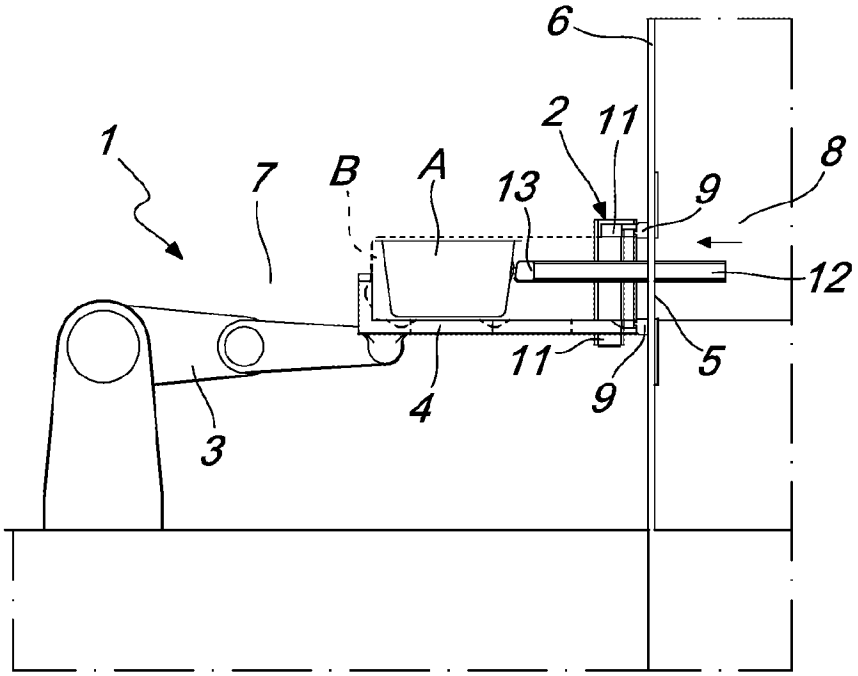
FIG. 3 is a schematic side view of a first embodiment of the extraction assembly of FIG. 1 in a third operating step.

With particular reference to a possible embodiment of undoubted practical interest, illustrated by way of example and not limiting in FIGS. 3 and 4, the assembly 1 can conveniently comprise a gripping unit 12 that is controlled by an actuator.

The gripping unit 12 will be well installed within the second environment 8 and will be mobile between a retracted configuration wherein it is fully contained within the second environment 8 and an extracted configuration wherein it will protrude at least partially within the first environment 7 through the opening 5 of the separation wall 6, when the closing partitions 9 are in the opening configuration.

It is deemed useful to specify that an end portion 13 of the gripping unit 12 is configured to removably grip the content A within the bag B in the extracted configuration, for dragging the content A within the second environment 8.

This removably grip ensures dragging of the content A inside the second environment when the gripping unit 12 moves from the extracted configuration to the retracted configuration.

Figure 6:
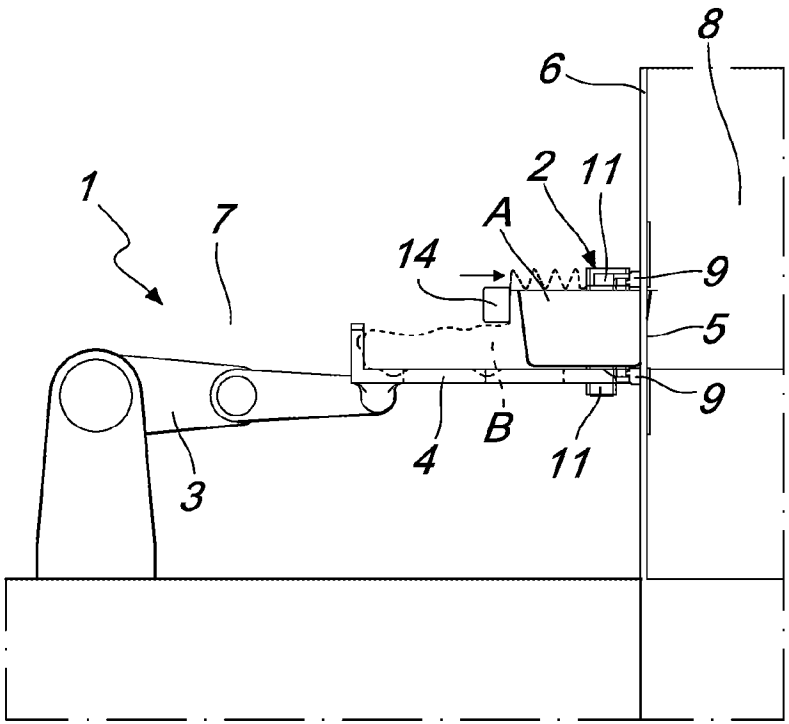
FIG. 6 is a schematic side view of the second embodiment of the extraction assembly of FIG. 1 in a fourth operating step.
Figure 5:
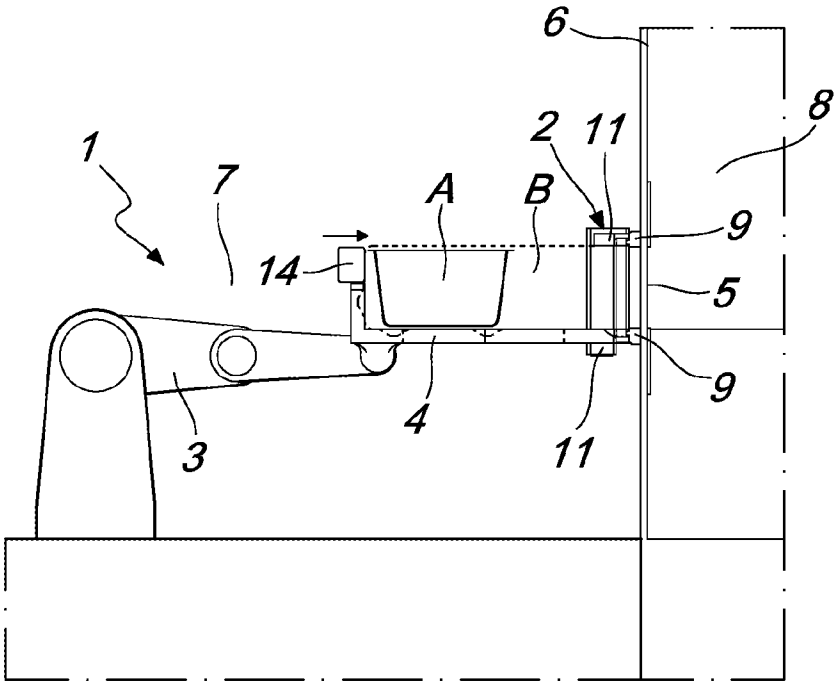
FIG. 5 is a schematic side view of a second embodiment of the extraction assembly of FIG. 1 in a third operating step.

According to an alternative embodiment, illustrated by way of example, and not limiting, in the attached FIGS. 5 and 6, the handling device 3 can advantageously comprise a pusher 14 arranged in substantial proximity to the supporting members 4 for the bag B.

When the closing partitions 9 are in the opening configuration (hence opening 5 is free) and the jaws 11 of the gripper 2 are separated and the bag B is opened and communicating with the second environment 8, the pusher 14 can grip a side of the content A.

This gripping of the pusher 14 on the content A allows the transfer of the content from the first environment 7 to the second environment 8 through the opening 5.

Figure 10:
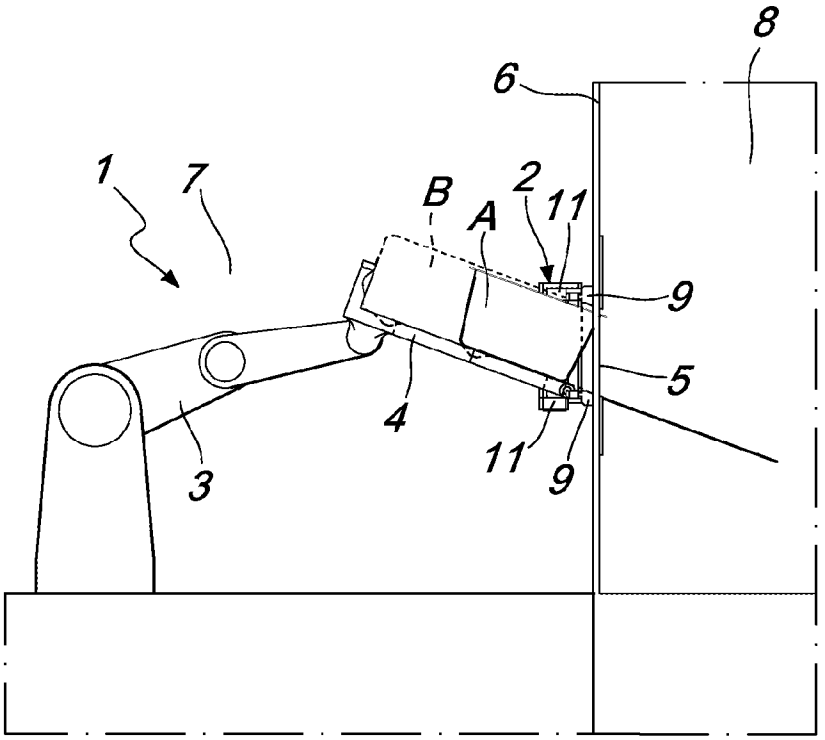
FIG. 10 is a schematic side view of the fourth embodiment of the extraction assembly of FIG. 1 in a fourth operating step.
Figure 9:
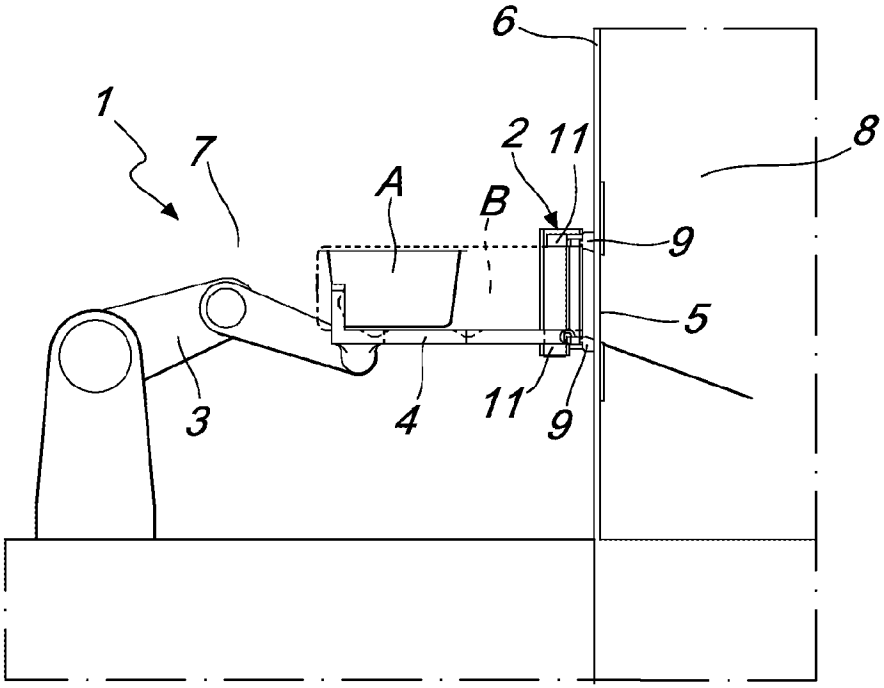
FIG. 9 is a schematic side view of a fourth embodiment of the extraction assembly of FIG. 1 in a third operating step.

With particular reference to a further embodiment, illustrated by way of example in the attached FIGS. 9 and 10 (without that the latter constitute any limitation to the application of the teachings of this invention), the supporting members 4 for the bag B can be validly oriented, by the action of the handling device 3, between a substantially horizontal arrangement wherein the content A is stable within the bag B and an inclined arrangement, wherein the content A is free to slide into the second environment 8.

The free sliding of the content B into the second environment 8 occurs when the supporting members 4 are kept in the inclined arrangement with the mouth of the bag B kept open by action of the retention device 15.

Figure 8:
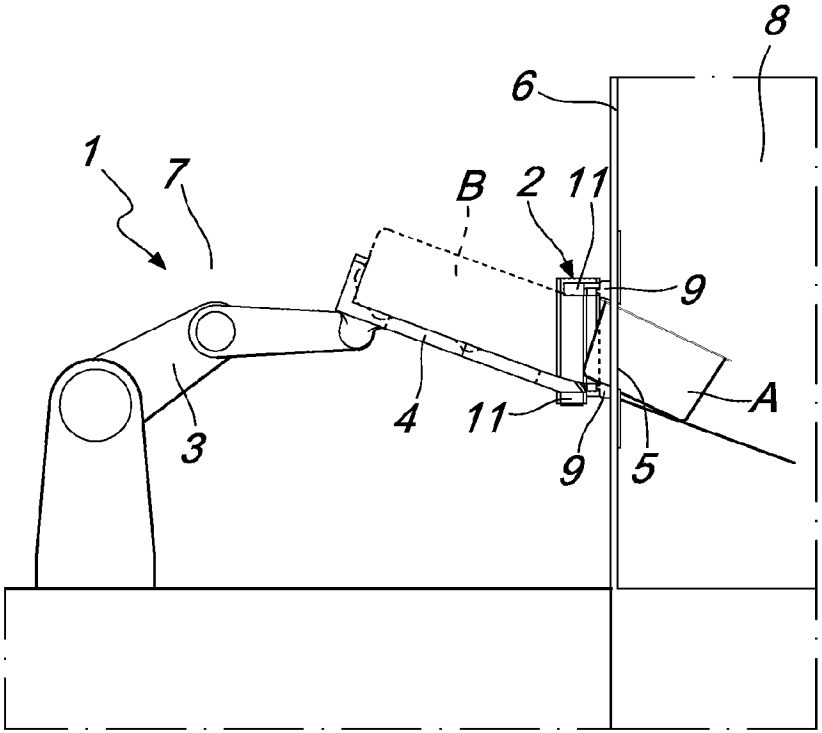
FIG. 8 is a schematic side view of the third embodiment of the extraction assembly of FIG. 1 in a fourth operating step.
Figure 7:
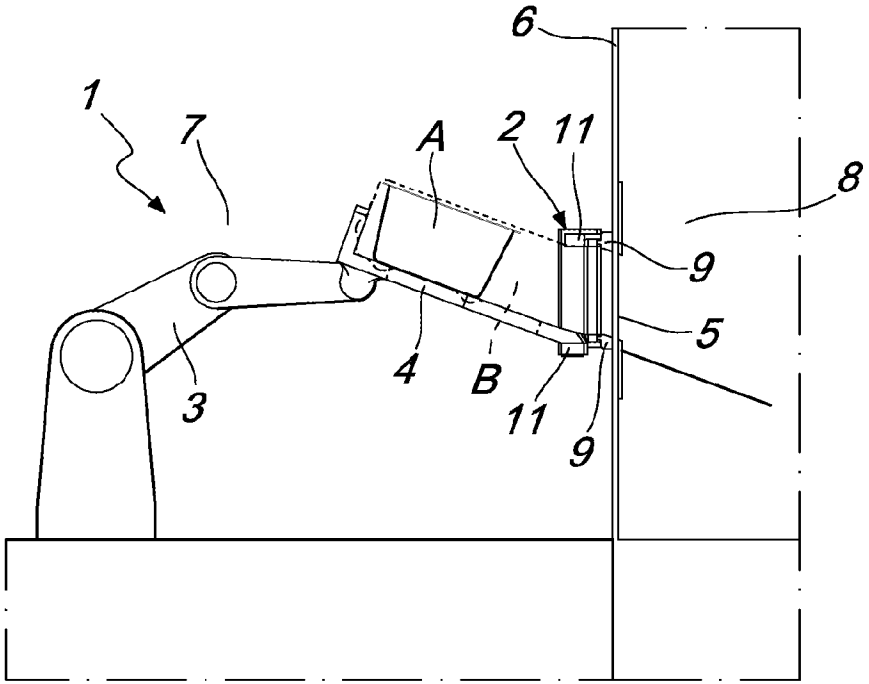
FIG. 7 is a schematic side view of a third embodiment of the extraction assembly of FIG. 1 in a third operating step.

According to an embodiment of this invention deriving from that described previously and which has been illustrated by way of example, but not limiting, in the attached FIGS. 7 and 8, the supporting members 4 can validly comprise an automatic retention device (for example, suction cup, clamp, movable gripper and the like) to lock the content A of the bag B.

The content A of bag B will thus be lockable and releasable by the retention device for the denial and the consent to the sliding of the content A in the second environment 8, through the opening 5, depending on the inclined arrangement of the respective supporting member 4.

With particular reference to the last embodiment just described, it is specified that it will be possible that the coupling of the supporting member 4 to the closing partitions 9 (in particular the coupling of the jaws 11, of the gripper 2 to the coupling elements 10) may also occur under inclined condition of the supporting member 4: in this case, as soon as the closing partitions 9 shall be opened (hence opening also the bag B mouth) it will only be the retention device to determine when content A shall be able to begin sliding into the second environment 8.

In particular in the pharmaceutical sector, a condition will occur according to which the first environment 7 and the second environment 8 will have a different contamination Class: the second environment 8 has a higher contamination Class and an internal pressure greater than the contamination Class and the internal pressure of the first environment 7, allowing a gas outflow from the second environment 8 to the first environment 7 through the opening 5.

The at least one retention device 15 allows the opening of the bag B mouth at the spacing apart of the closing partitions 9, as it retains the surface of the bag B sheet in adhesion on the surface thereof while the closing partitions 9 are displacing.

According to some possible embodiments, the at least one retention device 15 may comprise a suction cup configured to be coupled with a sheet of the bag B.

It is also possible to have a suction circuit with at least one slit, of any shape and/or dimension, shaped to be placed in contact with the surface of the respective coupling element 11 and intended to grip on a bag B sheet.

Advantageously, this invention solves the previously outlined problems by providing an extraction assembly 1 of a content A from a bag B for pharmaceutical and chemical sectors wherein the risk of contamination of the content A of the bag B is minimised since this content is exposed only to the environment with the cleanest level.

Advantageously, assembly 1 according to the invention allows to minimise the risk of contamination of the operating environment 8 wherein the content A of the bag B must be processed: in fact, only the content A reaches this operating environment 8 and the surfaces of the respective bag B never pass through the opening 5.

Moreover, assembly 1 according to the invention allows avoiding any exposure of the content A of the bag B to an environment having a contamination Class higher than the contamination of the environment wherein the content A will be processed.

By way of example, the content A, according to an embodiment of undoubted applicative interest, will be exposed only to environments with ISO Class "5" contamination or lower, corresponding to the environment Class wherein the content A thereof will be processed.

The invention thus conceived is susceptible to several modifications and variants all within the scope of the inventive concept; furthermore, all details could be replaced by other technically equivalent elements.

In the illustrated embodiments, individual characteristics, given in relation to specific examples, could in fact be interchanged with other different characteristics, existing in other embodiments.

Practically, the materials used, as well as the dimensions, could be any according to the requirements and the state of the art.

The invention claimed is:

1. An extraction assembly for extracting a content from a bag for pharmaceutical and chemical sectors, said bag having an end mouth formed by two opposing flaps, the extraction assembly comprising:

a separation wall which separates a first environment and a second environment at different contamination classes, said separation wall being provided with an opening communicating the first environment and the second environment, a closing partition associated with said opening and configured to be movable between a closing position to shut said opening and an opening position to free said opening, and a gripping element configured to grip said flaps of the end mouth of the bag in the first environment, the closing partition being configured to be coupled with said gripping element, wherein when the closing partition is coupled with the gripping element that grips the flaps of the end mouth of the bag, a spacing apart of said gripping element and/or of said closing partition causes an opening of the end mouth of the bag and freeing of the opening of the separation wall so as to let an inside of the bag and the content thereof to communicate with said second environment through said opening of the separation wall.

2. The extraction assembly according to claim 1, wherein said the gripping element is integral with a handling device housed in said first environment.

3. The extraction assembly according to claim 2, wherein said handling device comprises supporting members for supporting said bag, said handling device being movable along a path for carrying said supporting members close to said opening.

4. The extraction assembly according to claim 3, wherein said supporting members for said bag can be oriented, by the action of said handling device, between a substantially horizontal arrangement wherein said content is stable within said bag and a tilted arrangement wherein said content is free to slide into the said second environment through said opening when said bag is kept open by said closing partition.

5. The extraction assembly according to claim 3, wherein said handling device includes a locking device that can be activated for retaining the content of said bag to the supporting member.

6. The extraction assembly according to claim 1, comprising a gripping unit that is controlled by an actuator, said gripping unit being installed within said second environment and being movable between a retracted configuration wherein it is completely contained within said second environment and an extracted configuration wherein it protrudes into said first environment through said opening when said closing partitions are in the opening configuration.

7. The extraction assembly according to claim 6, wherein an end portion of said gripping unit is configured to removably grip the content of said bag in said extracted configuration, for dragging the content within said second environment.

8. The extraction assembly according to claim 1, comprising a pusher arranged to push the content within said bag from an outside of the bag for transferring said content from said first environment to said second environment through said opening, when said closing partition is in the open position.

9. The extraction assembly according to claim 8, wherein said pusher is associated with a handling device.

10. The extraction assembly according to claim 1, wherein the second environment has both a contamination class and an internal pressure greater that the contamination class and the internal pressure of the first environment, with consequent outflow of gas from the second environment to the first environment, when the closing partition is in the open configuration.

11. The extraction assembly according to claim 1, wherein the gripping element and/or the closing partition includes a suction cup configured to be coupled with the flaps of the end mouth of the bag (B).

12. The extraction assembly according to claim 1, wherein said gripping element is configured to keep closed the flaps of the end mouth of the bag hermetically.

13. An extraction assembly for extracting a content from a bag, said bag having an end mouth formed by two opposing flaps, the extraction assembly comprising:

a separation wall which separates a first environment and a second environment, said separation wall being provided with an opening, a partition element arranged in proximity to the opening and configured to be movable between a closing position to shut the opening and an opening position to free the opening, and a gripping element placed in the first environment and configured to grip the flaps of the end mouth of the bag and to be driven between an inactive configuration wherein the flaps of the end mouth of the bag are kept closed and an active configuration wherein the flaps of the end mouth of the bag are spaced apart to open the bag, wherein when the partition element is in the closing position, the gripping element is in the inactive configuration keeping the bag closed, and wherein when the partition element is moved to the opening position, the gripping element is driven in the active configuration of the bag so as to let the content inside the bag to be moved into the second environment passing through the opening.

* * * * *